US007152266B1

(12) United States Patent
Haughton

(10) Patent No.: US 7,152,266 B1
(45) Date of Patent: Dec. 26, 2006

(54) SCRUBBING DEVICE

(76) Inventor: Delaine Haughton, 118 Passaic Ave., #B14, Nutley, NJ (US) 07110

( * ) Notice: Subject to any disclaimer, the term of this patent is extended or adjusted under 35 U.S.C. 154(b) by 72 days.

(21) Appl. No.: 10/793,375

(22) Filed: Mar. 1, 2004

Related U.S. Application Data

(60) Provisional application No. 60/458,133, filed on Mar. 27, 2003.

(51) Int. Cl.
*A46B 13/02* (2006.01)

(52) U.S. Cl. ..... 15/28

(58) Field of Classification Search ..... 15/28, 15/29

See application file for complete search history.

(56) References Cited

U.S. PATENT DOCUMENTS

| | | | | | |
|---|---|---|---|---|---|
| 3,173,163 | A * | 3/1965 | Cramton | 15/159.1 |
| 3,407,424 | A * | 10/1968 | Lanzarone et al. | 15/145 |
| 4,217,671 | A | 8/1980 | Rand | |
| 4,305,234 | A * | 12/1981 | Pichelman | 451/463 |
| 4,724,563 | A * | 2/1988 | Fry et al. | 15/28 |
| 5,142,727 | A * | 9/1992 | Koester | 15/230 |
| 5,511,269 | A * | 4/1996 | Watson | 15/22.1 |
| 5,870,790 | A * | 2/1999 | Root et al. | 15/22.1 |
| 5,978,999 | A | 11/1999 | Deblois et al. | |
| 6,170,107 | B1 * | 1/2001 | George et al. | 15/24 |
| 6,253,405 | B1 | 7/2001 | Gutelius et al. | |
| 2003/0097724 | A1 * | 5/2003 | Park | 15/23 |
| 2004/0083567 | A1 * | 5/2004 | Lies | 15/28 |
| 2004/0117931 | A1 * | 6/2004 | Washington et al. | 15/29 |

* cited by examiner

*Primary Examiner*—Mark Spisich

(57) ABSTRACT

A scrubbing device for facilitating scrubbing of a surface. The scrubbing device includes a base member being designed for being gripped by a hand of a user. A brush member is rotatably coupled to the base member. The brush member is designed for engaging a surface whereby the brush member is for scrubbing the surface. A motor assembly is positioned in the base member. The motor assembly is operationally coupled to the brush member whereby the motor assembly is for rotating the brush member with respect to the base member to facilitate scrubbing of the surface. The base member being sealed whereby the base member is designed for inhibiting water from contacting the motor assembly and damaging the motor.

12 Claims, 3 Drawing Sheets

SCRUBBING DEVICE

REFERENCE TO RELATED APPLICATION

This application claims the benefit of U.S. provisional patent application Ser. No. 60/458,133, filed Mar. 27, 2003.

BACKGROUND OF THE INVENTION

1. Field of the Invention

The present invention relates to multipurpose cleaning devices and more particularly pertains to a new scrubbing device for facilitating scrubbing of a surface.

2. Description of the Prior Art

The use of multipurpose cleaning devices is known in the prior art. U.S. Pat. No. 4,127,671 describes a device for facilitating cleaning of toilets and other hard to reach areas. Another type of multipurpose cleaning device is U.S. Pat. No. 5,978,999 having a cleaning apparatus that is hand held and is used to scrub a surface. U.S. Pat. No. 6,253,405 has a cleaning apparatus with a movable cleaning section for scrubbing a surface.

While these devices fulfill their respective, particular objectives and requirements, the need remains for a device that has certain improved features that allows a user to reach areas that are not easily accessible.

SUMMARY OF THE INVENTION

The present invention meets the needs presented above by providing a telescopic base member that allows the length of the base member to be adjustable to allow the brush member to be applied to the surfaces that are not easily reached.

Still yet another object of the present invention is to provide a new scrubbing device that provides the brush member positioned perpendicular to the base member to allow the user to apply the maximum amount of force to the brush member to force the brush member against the surface.

Even still another object of the present invention is to provide a new scrubbing device that rotates the brush member to facilitate scrubbing of an area.

To this end, the present invention generally comprises a base member being designed for being gripped by a hand of a user. A brush member is rotatably coupled to the base member. The brush member is designed for engaging a surface whereby the brush member is for scrubbing the surface. A motor assembly is positioned in the base member. The motor assembly is operationally coupled to the brush member whereby the motor assembly is for rotating the brush member with respect to the base member to facilitate scrubbing of the surface. The base member being sealed whereby the base member is designed for inhibiting water from contacting the motor assembly and damaging the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
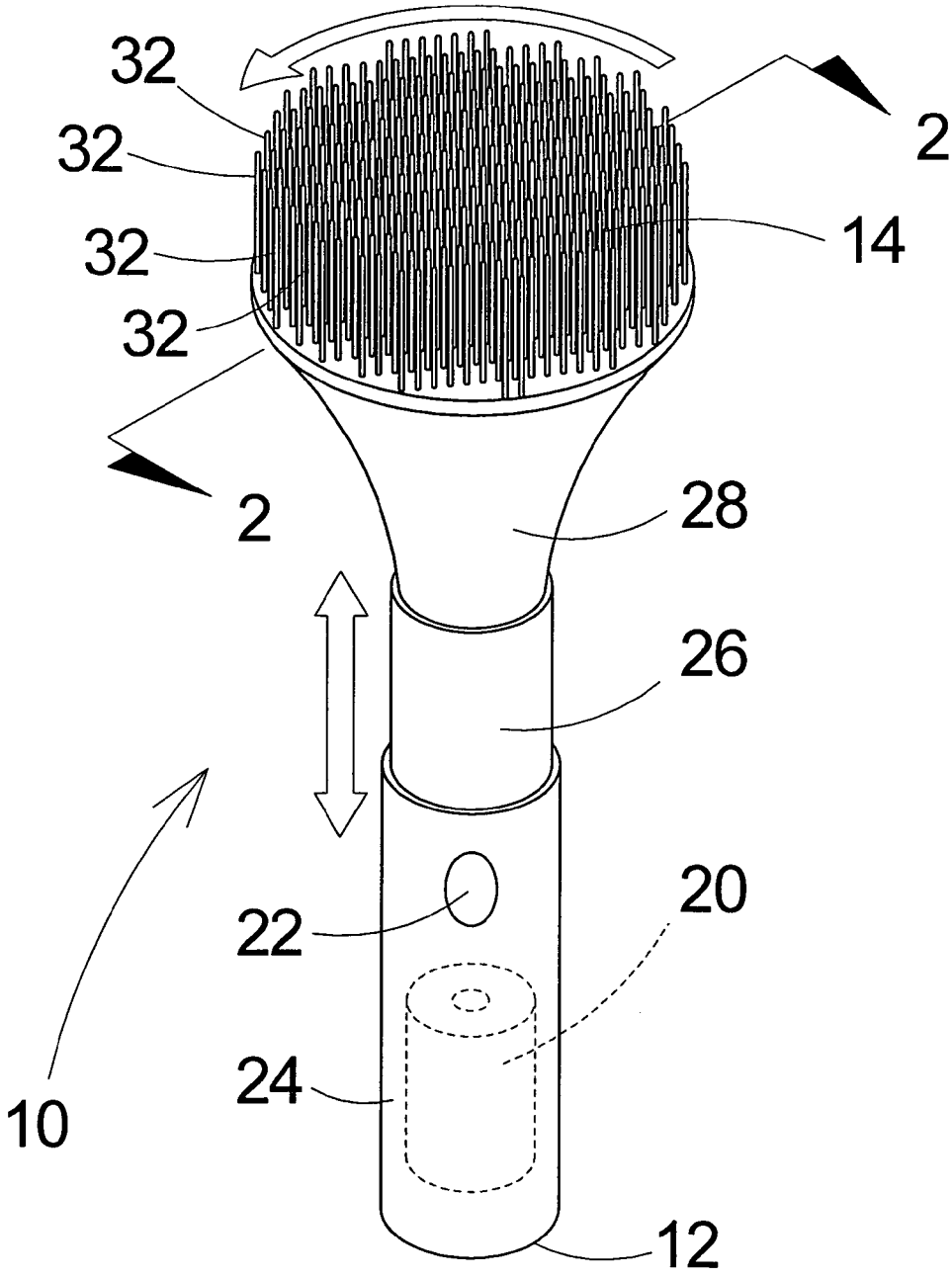
FIG. 1 is a perspective view of a new scrubbing device according to the present invention.
Figure 2:
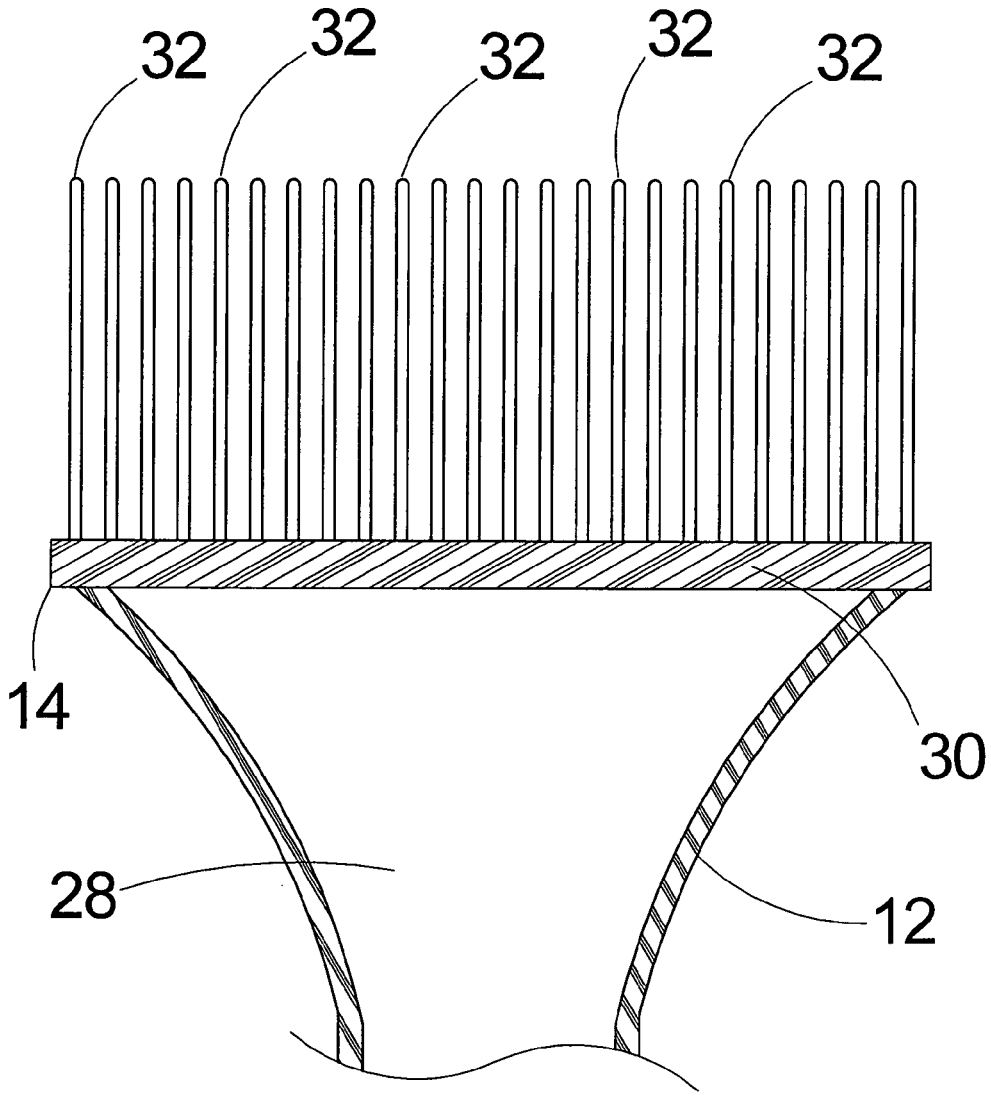
FIG. 2 is a cross-sectional view of the brush member of the present invention as taken along line 2—2 of FIG. 1.
Figure 3:
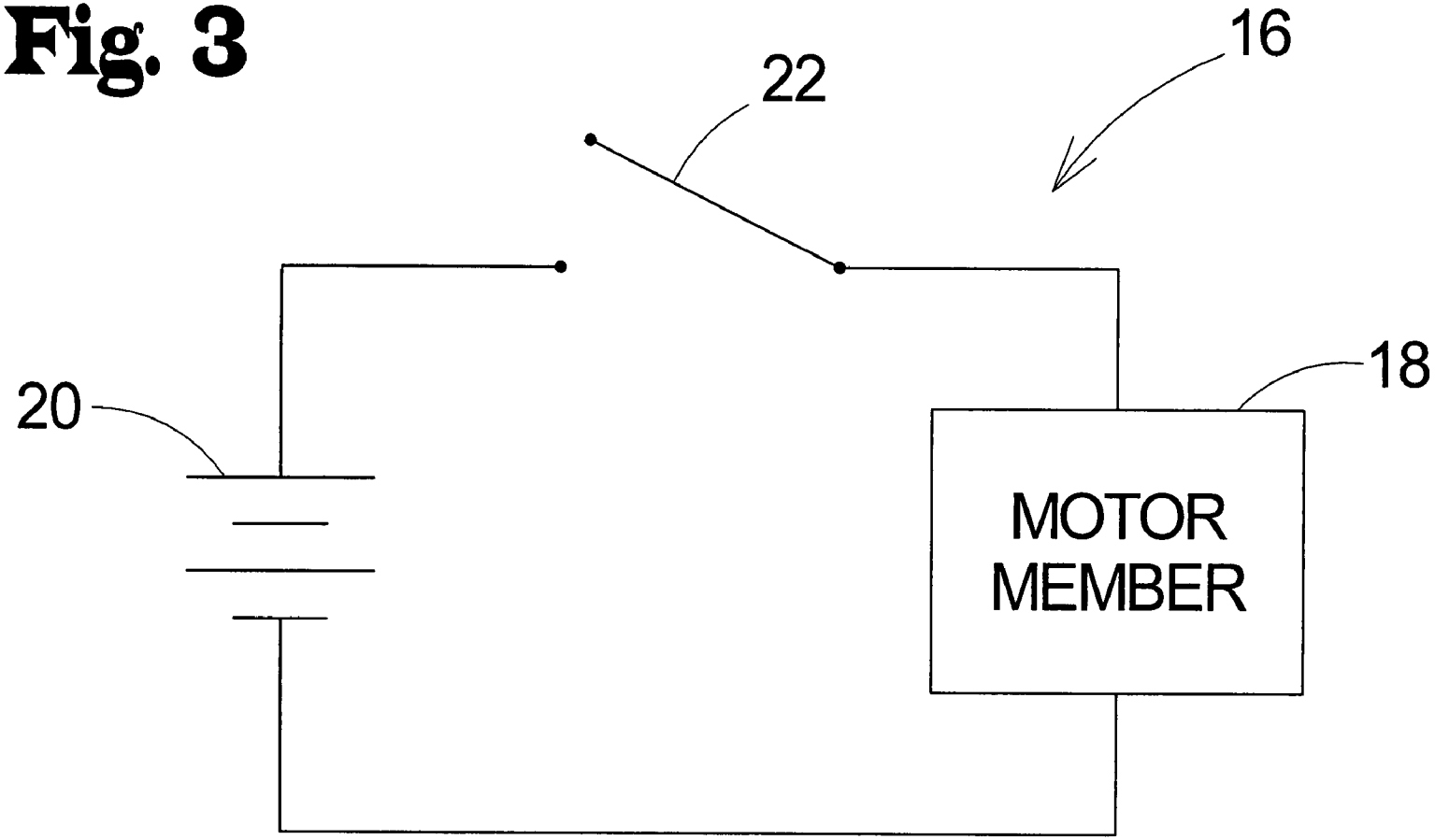
FIG. 3 is a schematic view of the motor assembly of the present invention.

With reference now to the drawings, and in particular to FIGS. 1 through 3 thereof, a new scrubbing device embodying the principles and concepts of the present invention and generally designated by the reference numeral 10 will be described.

As best illustrated in FIGS. 1 through 3, the scrubbing device 10 generally comprises a base member 12 being designed for being gripped by a hand of a user. The base member 12 has a diameter of about 1½ inches to comfortable fit in the hand of the user.

A brush member 14 is rotatably coupled to the base member 12. The brush member 14 is designed for engaging a surface whereby the brush member 14 is for scrubbing the surface. The brush member 14 is positioned substantially perpendicular to the base member 12.

A motor assembly 16 is positioned in the base member 12. The motor assembly 16 is operationally coupled to the brush member 14 whereby the motor assembly 16 is for rotating the brush member 14 with respect to the base member 12 to facilitate scrubbing of the surface. The base member 12 being sealed whereby the base member 12 is designed for inhibiting water from contacting the motor assembly 16 and damaging the motor assembly 16.

The motor assembly 16 comprises a motor member 18. The motor member 18 is positioned in the base member 12 whereby the motor member 18 is operationally coupled to the brush member 14. The motor member 18 is for rotating the brush member 14 with respect to the base member 12.

The motor assembly 16 comprises a power supply 20. The power supply 20 is positioned in the base member 12. The power supply 20 is operationally coupled to the motor member 18 whereby the power supply 20 is for supplying power to the motor member 18 to rotate the brush member 14.

The motor assembly 16 comprises a switch member 22. The switch member 22 is operationally coupled between the power supply 20 and the motor member 18. The switch member 22 is coupled to the base member 12 whereby the switch member 22 is for control the flow of power from the power supply 20 to the motor member 18 when the switch member 22 is actuated by the user.

The base member 12 comprises a handle portion 24, a medial portion 26 and a base portion 28. The medial portion 26 is telescopically coupled to the handle portion 24 whereby the medial portion 26 of the base member 12 is selectively telescopically extendable from the handle portion 24 to selectively adjust a length of the base member 12. The base portion 28 is telescopically coupled to the medial portion 26 opposite the handle portion 24 whereby the base portion 28 is selectively extendable from the medial portion 26 to selectively adjust the length of the base member 12. The length of the base member 12 can be extended from a length of about 12 inches to a length of about 35 inches. The motor member 18 maybe coupled to the brush member 14 by a telescopic drive shaft which allows the motor member 18 to continue rotation of the brush member 14 even when the base member 12 is extended.

The brush member 14 comprises a base plate 30 and a plurality of bristles 32. The bristles 32 are coupled to the base plate 30 whereby the bristles 32 extend outwardly from the base plate 30. The base plate 30 is operationally coupled to the motor assembly 16 whereby the base plate 30 is rotated by the motor assembly 16 to scrub the bristles 32 against the surface to be cleaned. Each of the bristles 32 comprises an absorbing material whereby the absorbing material is designed for absorbing a cleaning solution to be applied to the surface to facilitate cleaning of the surface. Each of the bristles 32 has a length of about 1 inch. The bristles 32 are substantially arranged in a circle having a circumference of about 20 inches allowing the user to direct the bristles 32 into tight areas.

In use, the user applies the cleaning solution to the bristles 32. The base portion 28 and the medial portion 26 of the base member 12 are telescopically adjusted with respect to the handle portion 24 to position the brush head at a desired length from the user. The switch member 22 is actuated by the user to allow power to flow from the power supply 20 to the motor member 18 so that to actuate the motor member 18 to rotate the brush member 14. The bristles 32 are then placed against the surface to be cleaned and the rotation of the brush member 14 scrubs the bristles 32 against the surface. When the cleaning has been completed the user actuates the switch member 22 to stop rotation of the brush head and retracts the medial portion 26 and the base portion 28 to shorten the length of the base member 12. The used cleaning solution is then rinsed from the bristles 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scrubbing device for cleaning surfaces, the scrubbing device comprising:

a base member being adapted for being gripped by a hand of a user;

a brush member being rotatably coupled to said base member, said brush member being adapted for engaging a surface such that said brush member is for scrubbing the surface;

a motor assembly being positioned in said base member, said motor assembly being operationally coupled to said brush member such that said motor assembly is for rotating said brush member with respect to said base member to facilitate scrubbing of the surface;

said brush member comprising a base plate and a plurality of bristles coupled to said base plate such that said bristles extend outwardly from said base plate, said base plate being coupled to said motor assembly such that said base plate is rotatable by said motor assembly;

each of said bristles comprising an absorbing material for absorbing a cleaning solution to be applied to the surface to facilitate cleaning of the surface;

wherein said base member includes a base portion and a medial portion, said base portion being positioned between said medial portion and said brush member; and wherein said base portion of said base member has a substantially frustaconical shape forming a smooth transition from said medial portion of said base member to said base plate of said brush member.

2. The scrubbing device as set forth in claim 1, further comprising:

said base member being sealed such that said base member is adapted for inhibiting liquid from entering said base member, said base member being adapted for inhibiting contact between said motor assembly and the liquid to inhibit the liquid damaging said motor assembly.

3. The scrubbing device as set forth in claim 1, further comprising:

said motor assembly comprising a motor member, said motor member being positioned in said base member, said motor member being operationally coupled to said brush member, said motor member being for rotating said brush member with respect to said base member.

4. The scrubbing device as set forth in claim 3, further comprising:

said motor assembly comprising a power supply, said power supply being positioned in said base member, said power supply being operationally coupled to said motor member such that said power supply is for supplying power to said motor member to rotate said brush member.

5. The scrubbing device as set forth in claim 4, further comprising:

said motor assembly comprising a switch member, said switch member being operationally coupled between said power supply and said motor member, said switch member being coupled to said base member such that said switch member is for controlling the flow of power from said power supply to said motor member when said switch member is actuated by the user.

6. The scrubbing device as set forth in claim 1, further comprising:

said base member comprising a handle portion, said medial portion being telescopically coupled to said handle portion such that said medial portion of said base member is selectively telescopically extendable from said handle portion to selectively adjust a length of said base member, said base portion being telescopically coupled to said medial portion opposite said handle portion such that said base portion is selectively extendable from said medial portion to selectively adjust said length of said base member, said base portion being rotatably coupled to said brush member.

7. The scrubbing device as set forth in claim 1, further comprising:

said brush member being positioned substantially perpendicular to said base member to facilitate a user using the weight of the user apply additional force to the brush member to facilitate scrubbing.

8. The scrubbing device as set forth in claim 1, wherein said base plate has a base surface from which said plurality of bristles extend, and said plurality of bristles extend in a substantially perpendicular orientation to the base surface of said base plate.

9. The scrubbing device as set forth in claim 1, wherein a diameter of said base portion adjacent to said base plate of said brush member is substantially equal to a diameter of said base plate.

10. The scrubbing device as set forth in claim 1, wherein said base member is elongated with a longitudinal axis, said plurality of bristles extending substantially parallel to the longitudinal axis of said base member.

11. A scrubbing device for cleaning surfaces, the scrubbing device comprising:

a base member being adapted for being gripped by a hand of a user;

a brush member being rotatably coupled to said base member, said brush member being adapted for engaging a surface such that said brush member is for scrubbing the surface;

a motor assembly being positioned in said base member, said motor assembly being operationally coupled to said brush member such that said motor assembly is for rotating said brush member with respect to said base member to facilitate scrubbing of the surface;

said base member being sealed such that said base member is adapted for inhibiting liquid from entering said base member, said base member being adapted for inhibiting contact between said motor assembly and the liquid to inhibit the liquid damaging said motor assembly;

said motor assembly comprising a motor member, said motor member being positioned in said base member, said motor member being operationally coupled to said brush member, said motor member being for rotating said brush member with respect to said base member;

said motor assembly comprising a power supply, said power supply being positioned in said base member, said power supply being operationally coupled to said motor member such that said power supply is for supplying power to said motor member to rotate said brush member;

said motor assembly comprising a switch member, said switch member being operationally coupled between said power supply and said motor member, said switch member being coupled to said base member such that said switch member is for controlling the flow of power from said power supply to said motor member when said switch member is actuated by the user;

said base member comprising a handle portion, a medial portion and a base portion, said medial portion being telescopically coupled to said handle portion such that said medial portion of said base member is selectively telescopically extendable from said handle portion to selectively adjust a length of said base member, said base portion being telescopically coupled to said medial portion opposite said handle portion such that said base portion is selectively extendable from said medial portion to selectively adjust said length of said base member, said base portion being rotatably coupled to said brush member;

said brush member comprising a base plate and a plurality of bristles coupled to said base plate such that said bristles extend outwardly from said base plate, said base plate being coupled to said motor assembly such that said base plate is rotatable by said motor assembly;

each of said bristles comprising an absorbing material for absorbing a cleaning solution to be applied to the surface to facilitate cleaning of the surface;

wherein said base plate has a base surface from which said plurality of bristles extend, and said plurality of bristles extend in a substantially perpendicular orientation to the base surface of said base plate;

wherein said base portion of said base member has a substantially frustaconical shape forming a smooth transition from said medial portion of said base member to said base plate of said brush member;

wherein a diameter of said base portion adjacent to said base plate of said brush member is substantially equal to a diameter of said base plate;

wherein said base member is elongated with a longitudinal axis, said plurality of bristles extending substantially parallel to the longitudinal axis of said base member.

12. A scrubbing device for cleaning surfaces, the scrubbing device comprising:

a base member being adapted for being gripped by a hand of a user, said base member including a handle portion, a medial portion and a base portion, said medial portion being telescopically coupled to said handle portion such that said medial portion is selectively telescopically extendable from said handle portion to selectively adjust a length of said base member, said base portion being telescopically coupled to said medial portion opposite said handle portion such that said base portion is selectively extendable from said medial portion to selectively adjust said length of said base member;

a brush member being rotatably coupled to said base member, said brush member having a base plate and a plurality of bristles extending from said base plate; and a motor assembly being positioned in said base member, said motor assembly being operationally coupled to said brush member such that said motor assembly is for rotating said brush member with respect to said base member to facilitate scrubbing of the surface;

wherein a diameter of said base portion of said base member located adjacent to said base plate of said brush member is substantially equal to a diameter of said base plate.

* * * * *